US007093656B2

(12) United States Patent
Maguire

(10) Patent No.: US 7,093,656 B2
(45) **Date of Patent: *Aug. 22, 2006**

(54) SOLID EXPANDABLE HANGER WITH COMPLIANT SLIP SYSTEM

(75) Inventor: Patrick G. Maguire, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 216 days.

This patent is subject to a terminal disclaimer.

(21) Appl. No.: 10/428,163

(22) Filed: May 1, 2003

(65) Prior Publication Data

US 2004/0216894 A1 Nov. 4, 2004

(51) Int. Cl.
*E21B 29/10* (2006.01)
*E21B 23/01* (2006.01)

(52) U.S. Cl. ..... 166/277; 166/384; 166/297; 166/55.1; 166/207

(58) Field of Classification Search ..... 166/277, 166/381, 382, 384, 387, 380, 297, 298, 55, 166/55.1, 206, 207, 208, 212, 216, 217, 242.6
See application file for complete search history.

(56) References Cited

U.S. PATENT DOCUMENTS

| | | | | |
|---|---|---|---|---|
| 4,523,641 | A | 6/1985 | Manderscheid | |
| 5,366,012 | A | 11/1994 | Lohbeck | |
| 5,454,493 | A | 10/1995 | Laroche et al. | |
| 5,620,052 | A | 4/1997 | Turner | |
| 6,012,523 | A | 1/2000 | Campbell et al. | |
| 6,325,148 | B1 * | 12/2001 | Trahan et al. | 166/297 |
| 6,425,444 | B1 | 7/2002 | Metcalfe et al. | |
| 6,446,323 | B1 * | 9/2002 | Metcalfe et al. | 29/523 |
| 6,446,724 | B1 * | 9/2002 | Baugh et al. | 166/285 |
| 6,457,532 | B1 | 10/2002 | Simpson | |
| 6,598,678 | B1 * | 7/2003 | Simpson et al. | 166/297 |
| 6,631,765 | B1 * | 10/2003 | Baugh et al. | 166/285 |
| 6,648,075 | B1 | 11/2003 | Badrak et al. | |
| 6,662,876 | B1 * | 12/2003 | Lauritzen | 166/380 |
| 6,666,276 | B1 | 12/2003 | Yokley et al. | |
| 6,688,397 | B1 | 2/2004 | McClurkin et al. | |
| 6,688,399 | B1 * | 2/2004 | Maguire et al. | 166/382 |
| 6,691,789 | B1 * | 2/2004 | Jackson et al. | 166/384 |
| 6,702,029 | B1 * | 3/2004 | Metcalfe et al. | 166/378 |
| 6,722,427 | B1 | 4/2004 | Gano et al. | |
| 6,722,441 | B1 | 4/2004 | Lauritzen et al. | |
| 2001/0020532 | A1 * | 9/2001 | Baugh et al. | 166/285 |
| 2002/0060079 | A1 | 5/2002 | Metcalfe et al. | |

(Continued)

FOREIGN PATENT DOCUMENTS

GB 2345308 A * 7/2000

(Continued)

OTHER PUBLICATIONS

U.K. Search Report, Application No. GB0409684.8, dated Aug. 6, 2004.

(Continued)

*Primary Examiner*—Jennifer H. Gay
(74) *Attorney, Agent, or Firm*—Patterson & Sheridan, LLP

(57) ABSTRACT

An apparatus for forming an expanded connection in a wellbore, whereby the apparatus includes a first tubular being radially expandable outward into contact with an inner wall of a second tubular upon the application of an outwardly directed force supplied to an inner surface of the first tubular. The apparatus further includes a plurality of formations formed on an outer surface of the first tubular, the formations constructed and arranged to provide a frictional relationship between the first tubular and the second tubular while leaving a fluid path when the first tubular is expanded to engage the inner wall of the second tubular.

23 Claims, 8 Drawing Sheets

U.S. PATENT DOCUMENTS

| | | | | |
|---|---|---|---|---|
| 2002/0139540 | A1* | 10/2002 | Lauritzen | 166/387 |
| 2002/0166668 | A1* | 11/2002 | Metcalfe et al. | 166/378 |
| 2003/0042022 | A1 | 3/2003 | Lauritzen et al. | |
| 2003/0047320 | A1* | 3/2003 | Badrak et al. | 166/380 |
| 2003/0047322 | A1* | 3/2003 | Maguire et al. | 166/380 |
| 2003/0047323 | A1* | 3/2003 | Jackson et al. | 166/380 |
| 2003/0056948 | A1* | 3/2003 | Cameron | 166/206 |
| 2003/0062171 | A1 | 4/2003 | Maguire et al. | |
| 2003/0098164 | A1 | 5/2003 | Hirth | |
| 2003/0106698 | A1* | 6/2003 | Simpson et al. | 166/382 |
| 2003/0111234 | A1 | 6/2003 | McClurkin et al. | |
| 2003/0131997 | A1 | 7/2003 | Chatterji et al. | |
| 2003/0188868 | A1* | 10/2003 | Simpson et al. | 166/298 |
| 2004/0099423 | A1* | 5/2004 | Badrak et al. | 166/380 |
| 2004/0177953 | A1 | 9/2004 | Wubben | |
| 2004/0216891 | A1* | 11/2004 | Maguire | 166/380 |
| 2004/0216893 | A1* | 11/2004 | Hirth | 166/382 |
| 2004/0251033 | A1* | 12/2004 | Cameron et al. | 166/382 |
| 2004/0256098 | A1* | 12/2004 | Ducasse et al. | 166/207 |

FOREIGN PATENT DOCUMENTS

| | | |
|---|---|---|
| GB | 2 350 137 | 11/2000 |
| WO | WO 02/38343 | 5/2002 |
| WO | WO 03/006790 | 1/2003 |

OTHER PUBLICATIONS

U.K. Search Report, Application No. GB0409684.8, dated Dec. 1, 2005.

* cited by examiner

SOLID EXPANDABLE HANGER WITH COMPLIANT SLIP SYSTEM

BACKGROUND OF THE INVENTION

1. Field of the Invention

The present invention relates to wellbore completion. More particularly, the invention relates to an apparatus and method for creating an attachment and a seal between two tubulars in a wellbore.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is lined with a string of steel pipe called casing. The casing provides support to the wellbore and facilitates the isolation of certain areas of the wellbore adjacent hydrocarbon bearing formations. The casing typically extends down the wellbore from the surface of the well to a designated depth. An annular area is thus defined between the outside of the casing and the earth formation. This annular area is filled with cement to permanently set the casing in the wellbore and to facilitate the isolation of production zones and fluids at different depths within the wellbore.

It is common to employ more than one string of casing in a wellbore. In this respect, a first string of casing is set in the wellbore when the well is drilled to a first designated depth. The well is then drilled to a second designated depth, and a second string of casing, or liner, is run into the well to a depth whereby the upper portion of the second liner is overlapping the lower portion of the first string of casing. The second liner string is then fixed or hung in the wellbore, usually by some mechanical slip mechanism well known in the art, and cemented. This process is typically repeated with additional casing strings until the well has been drilled to total depth.

A recent trend in well completion has been the advent of expandable tubular technology. It has been discovered that both slotted and solid tubulars can be expanded in situ so as to enlarge the inner diameter. This, in turn, enlarges the path through which both fluid and downhole tools may travel. Also, expansion technology enables a smaller tubular to be run into a larger tubular, and then expanded so that a portion of the smaller tubular is in contact with the larger tubular therearound. Tubulars are expanded by the use of a cone-shaped mandrel or by an expansion tool with expandable, fluid actuated members disposed on a body and run into the wellbore on a tubular string. During expansion of a tubular, the tubular walls are expanded past their elastic limit. The use of expandable tubulars as liner hangers and packers allows for the use of larger diameter production tubing, because the conventional slip mechanism and sealing mechanism are eliminated.

If the liner hanger is expanded by a cone-shaped mandrel, then a forgiving material is typically employed between the outer diameter of the liner hanger and the inner diameter of the larger tubular to accommodate any variances in the inner diameter of the larger tubular. It is this forgiving material that provides the mechanism for hanging the weight of the liner below the liner hanger. Typically, the forgiving material is made from a nitrile rubber compound or a similar material.

It is usually desirable to expand the liner hanger to support the weight of a liner and then release the running tool from the liner prior to cementing the liner in place. Typically, the use of the cone-shaped mandrel requires that circulation ports be cut in the wall of the liner, directly below the liner hanger section to provide a fluid path for exiting wellbore fluid and cement during the cementing process. Then, following the cementing process, these ports must be isolated by expanding another elastomer clad section below the ports.

While expanding liner hangers by the cone-shaped mandrel in a wellbore offers obvious advantages, however, there are problems associated with using the technology. For example, by using a forgiving material, such as a nitrile rubber compound, the liner hanging mechanism may only be effectively utilized in a wellbore that has a temperature of less 250° F. If the liner hanger is used in a higher temperature wellbore, then the rubber's ability to carry a load drops off dramatically due to the mechanical properties of the material. More importantly, the circulating ports that are cut into the wall of the liner below the liner hanger diminish the carrying capacity of the hanger due to a reduction of material through this section therefore limiting the length of the liner.

A need therefore exists for a solid expandable hanger that provides for a cement bypass without compromising the carrying capacity of the hanger. There is a further need for a solid expandable hanger that is capable of enduring a high temperature installation. Furthermore, there is a need for an improved expandable liner hanger with a means for circulating fluids therearound.

SUMMARY OF THE INVENTION

The present invention generally relates to an apparatus and method for engaging a first tubular and a second tubular in a wellbore. In one aspect, an apparatus for forming an expanded connection in a wellbore is provided. The apparatus includes a first tubular being radially expandable outward into contact with an inner wall of a second tubular upon the application of an outwardly directed force supplied to an inner surface of the first tubular. The apparatus further includes a plurality of formations formed on an outer surface of the first tubular, the formations constructed and arranged to provide a frictional relationship between the first tubular and the second tubular while leaving a fluid path when the first tubular is expanded to engage the inner wall of the second tubular.

In another aspect, an apparatus for engaging a first tubular and a second tubular in a wellbore is provided. The apparatus includes a tubular body formed on the first tubular, having an inner surface and an outer surface, the tubular body being expandable radially outward into contact with an inner wall of the second tubular by the application of an outwardly directed force supplied to the inner surface of the tubular body. The apparatus further includes a plurality of formations formed around the circumference of the tubular body, the plurality of formations are constructed and arranged to provide a frictional relationship between the tubular body and the second tubular while leaving a fluid path through the expanded connection and a gripping means formed on the plurality of formations for further increasing friction between the tubular body and the second tubular upon expansion of the tubular body.

In yet another aspect, a method of completing a wellbore is provided. The method includes placing a first tubular coaxially within a portion of a second tubular, the first tubular including a plurality of formations on an outer surface thereof to provide a frictional relationship between the first tubular and the second tubular while leaving a fluid path through the expanded connection and positioning an expander tool within the first tubular at a depth proximate the plurality of formations on the first tubular. The method further includes urging the expander tool axially through the first tubular to expand the first tubular into frictional contact with the second tubular and forming a fluid path through an overlapped portion between the first and second tubulars. The method also includes circulating cement through the wellbore and subsequently through the fluid path to secure the first tubular in the wellbore and expanding at least one tubular seal to close off the fluid path and create a fluid seal between the first and second tubulars.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention relates to a method and an apparatus for forming a solid expandable hanger connection with a surrounding casing. Generally, a liner assembly including a liner hanger is disposed in a wellbore proximate the lower end of the surrounding casing. Next, an expander tool is urged axially through the liner hanger to radially expand the hanger into frictional contact with the surrounding casing and to form a plurality of cement bypass ports. Thereafter, cement is circulated through the wellbore and eventually through the plurality of cement bypass ports to cement the liner assembly within the wellbore. Subsequently, a liner seal is radially expanded to seal off the plurality cement bypass ports.

Figure 1:
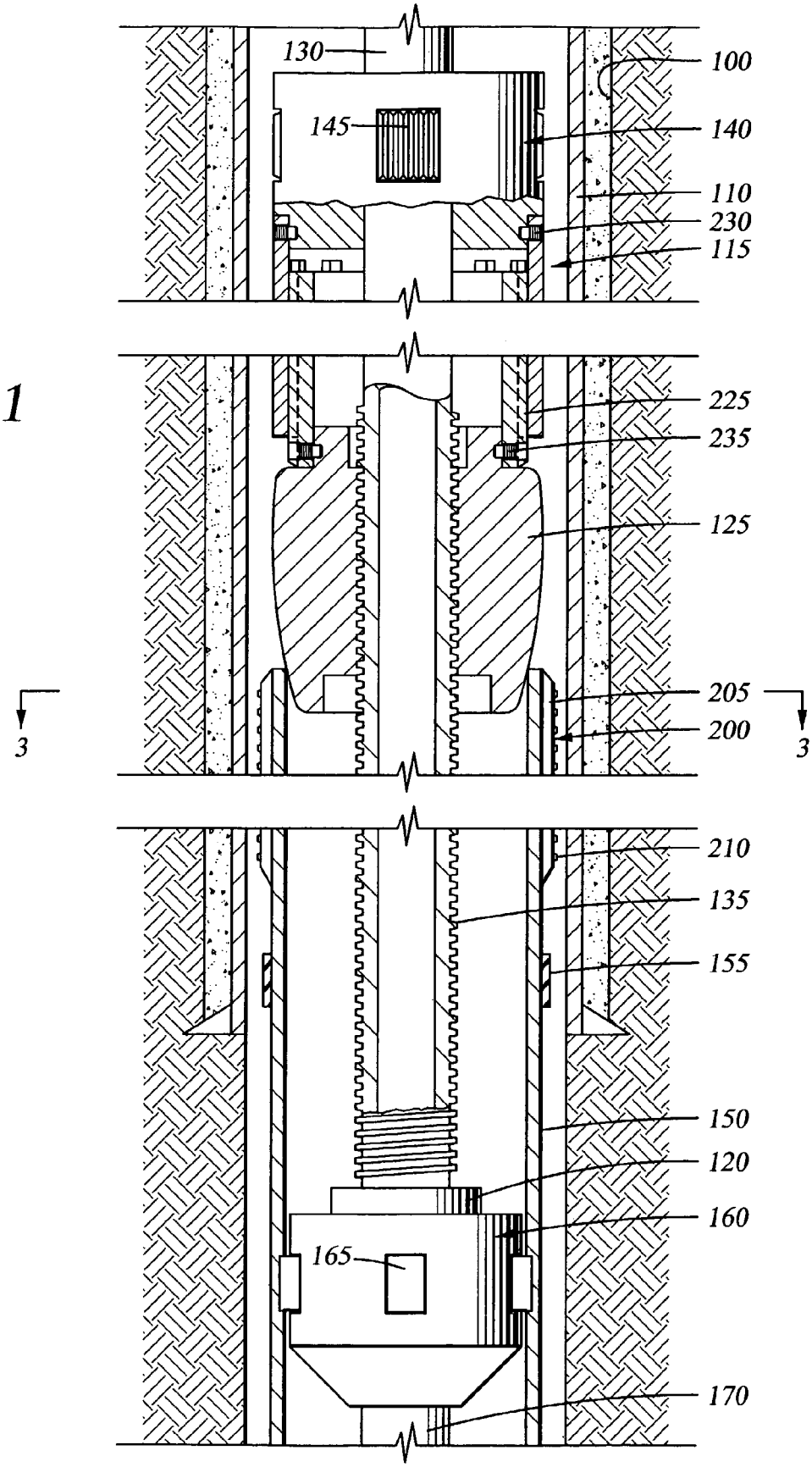
FIG. 1 is a cross-sectional view illustrating a solid expandable hanger of the present invention in a run-in position.

FIG. 1 is a cross-sectional view illustrating a solid expandable hanger 200 of the present invention in a run-in position. At the stage of completion shown in FIG. 1, a wellbore 100 has been lined with a string of casing 110. Thereafter, a subsequent liner assembly 150 is positioned proximate the lower end of the casing 110. Typically, the liner assembly 150 is lowered into the wellbore 100 by a running tool 115 disposed at the lower end of a working string 130.

At the upper end of the running tool 115 is an upper torque anchor 140. Preferably, the torque anchor 140 defines a set of slip members 145 disposed radially around the torque anchor 140. In the embodiment of FIG. 1, the slip members 145 define at least two radially extendable pads with surfaces having gripping formations like teeth formed thereon to prevent rotational movement. As illustrated, the torque anchor 140 is in its recessed position, meaning that the pads 145 are substantially within the plane of the casing 110. In other words, the pads 145 are not in contact with the casing 110 so as to facilitate the run-in of the liner assembly 150. The pads 145 are selectively actuated either hydraulically or mechanically or combinations thereof as known in the art.

A spline assembly 225 is secured at one end to the torque anchor 140 by a plurality of upper torque screws 230 and secured at the other end to an axially movable expander tool 125 by a plurality of lower torque screws 235. As used herein, a spline assembly means a mechanical torque connection between a first and second member. Typically, the first member includes a plurality of keys and the second member includes a plurality of keyways. When rotational torque is applied to the first member, the keys act on the keyways to transmit the torque to the second member. Additionally, the spline assembly permits axial movement between the first and second member while maintaining the torque connection. In this respect, the torque anchor 140 maintains the expander tool 125 rotationally stationary while permitting the expander tool 125 to move axially.

The axially movable expander tool 125 is disposed on a threaded mandrel 135. Expander tools are well known in the art and are generally used to radially enlarge an expandable tubular by urging the expander tool axially through the tubular, thereby swaging the tubular wall radially outward as the larger diameter tool is forced through the smaller diameter tubular member. In the embodiment shown, the expander tool 125 includes female threads formed on an inner surface thereof that mate with male threads formed on the threaded mandrel 135. As the threaded mandrel 135 is rotated, the expander tool 125 moves axially through the hanger 200 to expand it outward in contact with the casing 110. It is to be understood, however, that other means may be employed to urge the expander tool 125 through the hanger 200 such as hydraulics or any other means known in the art. Furthermore, the expander tool 125 may be disposed in the hanger 200 in any orientation, such as in a downward orientation as shown for a top down expansion or in an upward orientation for a bottom up expansion. Additionally, an expandable tool may be employed. Preferably, the expandable tool moves between a first smaller diameter and a second larger diameter, thereby allowing for both a top down expansion and a bottom up expansion depending on the directional axial movement of the expandable tool.

Disposed below the threaded mandrel 135 is a swivel 120. Generally, the swivel 120 permits the relative rotation of a threaded mandrel 135 while the supporting torque anchor 140, and the hanger 200, remain rotationally stationary. A downhole tool 160 with extendable members 165 is located below the swivel 120.

As shown in FIG. 1, the downhole tool 160 is in its extended position, meaning that the extendable members 165 are in contact with the inner surface of the liner assembly 150 so as to secure the liner assembly 150 to the running tool 115. The extendable members 165 are selectively actuated either hydraulically or mechanically or both as known in the art. Furthermore, a fluid outlet 170 is provided at the lower end of the downhole tool 160. The fluid outlet 170 serves as a fluid conduit for cement to be circulated into the wellbore 100 in accordance with the method of the present invention.

The liner assembly 150 includes the expandable hanger 200 of this present invention. The expandable hanger 200 comprises of a plurality of formations that are illustrated as a plurality of ribs 205 formed on the outer surface of the hanger 200. The plurality of ribs 205 are circumferentially spaced around the hanger 200 to provide support for the liner assembly 150 upon expansion of the hanger 200. As illustrated, a plurality of inserts 210 are disposed on the ribs 205. The inserts 210 provide a gripping means between the outer surface of the hanger 200 and the inner surface of the casing 110 within which the liner assembly 150 is coaxially disposed. The inserts 210 are made of a suitably hardened material, and are attached to the outer surface of the ribs 205 of the hanger 200 through a suitable means such as soldering, epoxying or other adhesive methods, or via threaded connection. In the preferred embodiment, inserts 210 are press-fitted into preformed apertures in the outer surface of the ribs 205 of the hanger 200. After expansion, the inserts 210 are engaged with the inner surface of the surrounding casing 110, thereby increasing the ability of the expanded hanger 200 to support the weight of the liner assembly 150 below the expanded portion.

In the preferred embodiment, the inserts 210 are fabricated from a tungsten carbide material. However, another fabrication material may be employed, so long as the material has the capability of gripping the inner surface of the casing 110 during expansion of the hanger 200. Examples of fabrication materials for the inserts 210 include ceramic materials (such as carbide) and hardened metal alloy materials. The carbide inserts 210 define raised members fabricated into the hanger 200. However, other embodiments of gripping means may alternatively be employed. Such means include, but are not limited to, buttons having teeth (not shown), or other raised or serrated members on the outer surface of the ribs 205 of the hanger 200. The gripping means may also include a plurality of long inserts defined on the outside diameter of the hanger 200, thus creating a plurality of flutes (not shown) between the plurality of long inserts. Alternatively, the gripping means may define a plurality of hardened tooth patterns added to the outer surface of the ribs 205 of the hanger 200.

In the embodiment shown in FIG. 1, the liner assembly 150 includes a liner seal 155 disposed below the expandable hanger 200. The primary purpose of the liner seal 155 is to seal off the expandable hanger 200 after a cementation operation is complete, as will be discussed in a subsequent paragraph. Generally, the liner seal 155 creates a fluid seal between the liner assembly 150 and the casing 110 upon expansion of the liner seal 155. In the preferred embodiment, the liner seal 155 is fabricated from an elastomeric material. However, other material may be employed that is capable of creating the fluid seal sought to be obtained between the expanded portion of the liner assembly 150 and the casing 110. Typically, the liner seal 155 is disposed around the liner assembly 150 by a thermal process, or some other well known means.

Although the liner assembly 150 in FIG. 1 shows only one liner seal 155 disposed below the expandable hanger 200, the invention is not limited to this particular location or the quantity illustrated. For instance, any number of liner seals may be employed with the expandable hanger 200 of the present invention and the liner seals may be placed in any location adjacent the expandable hanger 200 to create a fluid seal between the liner assembly 150 and the casing 110. For example, the liner seal 155 may be employed both above and below the expandable hanger 200 to form a fluid seal between the liner assembly 150 and the casing 110.

Figure 2:
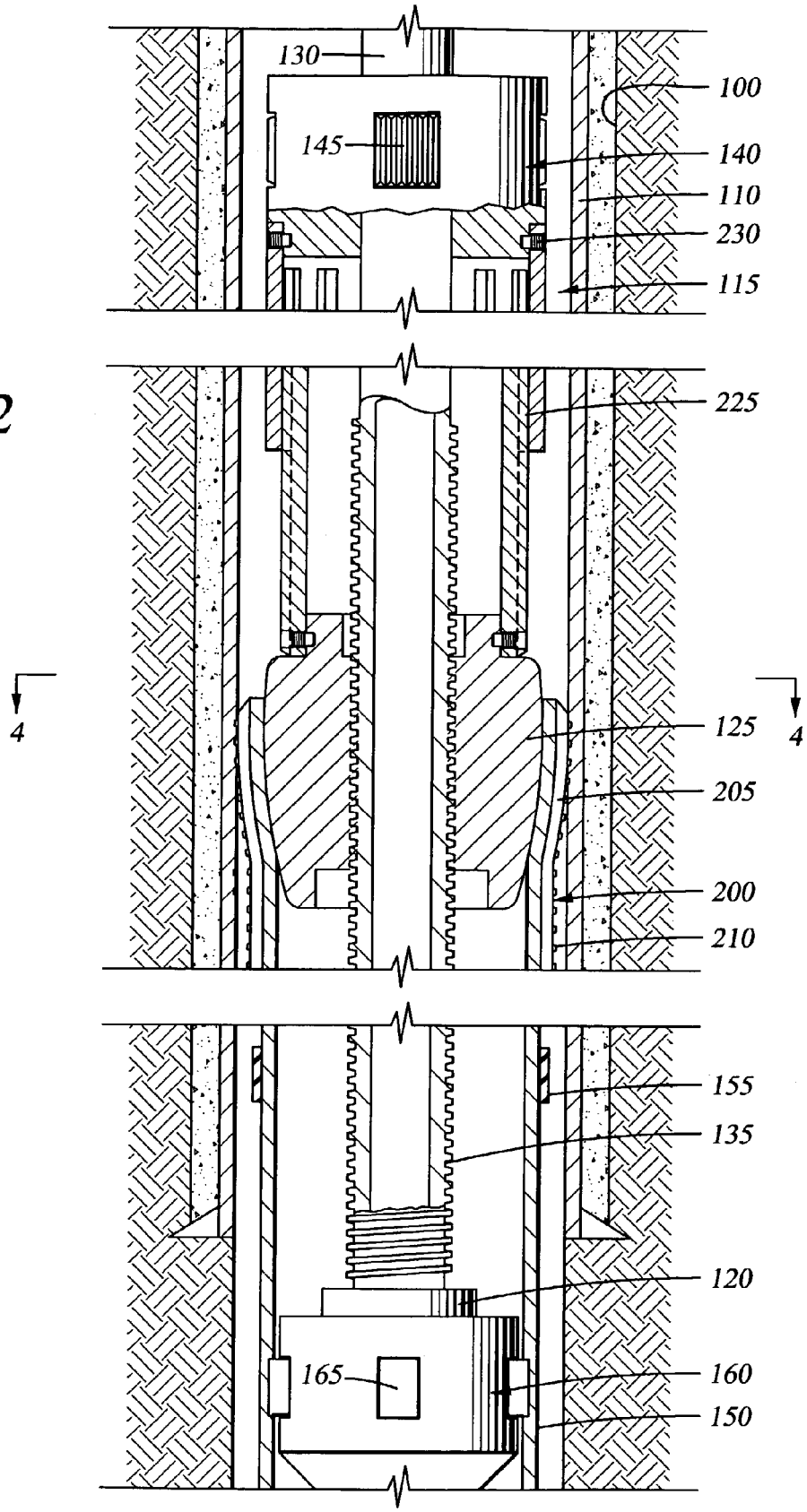
FIG. 2 is a cross-sectional view illustrating an expander tool partially expanding the solid expandable hanger.

FIG. 2 is a cross-sectional view illustrating the expander tool 125 partially expanding the solid expandable hanger 200. As shown, the liner assembly 150 is positioned proximate the lower end of the casing 110. Thereafter, the upper torque anchor 140 is actuated, thereby extending the pads 145 radially outward into contact with the surrounding casing 110. Subsequently, rotational force is transmitted through the working string 130 to the threaded mandrel 135. The swivel 120 permits the threaded mandrel 135 to rotate in a first direction while the torque anchor 140, the spline assembly 225, expander tool 125, and liner assembly 150 remain stationary. As the threaded mandrel 135 rotates, the expander tool 125 moves axially in a first direction through the expandable hanger 200 causing the hanger 200 to expand radially outward forcing the inserts 210 to contact the inner surface of the casing 110 as illustrated. The expander tool 125 continues to expand the entire length of the expandable hanger 200 until it reaches a predetermined point above the liner seal 155. At that point, the expansion is stopped to prevent expanding the liner seal 155, in anticipation of cementing.

Figure 3:
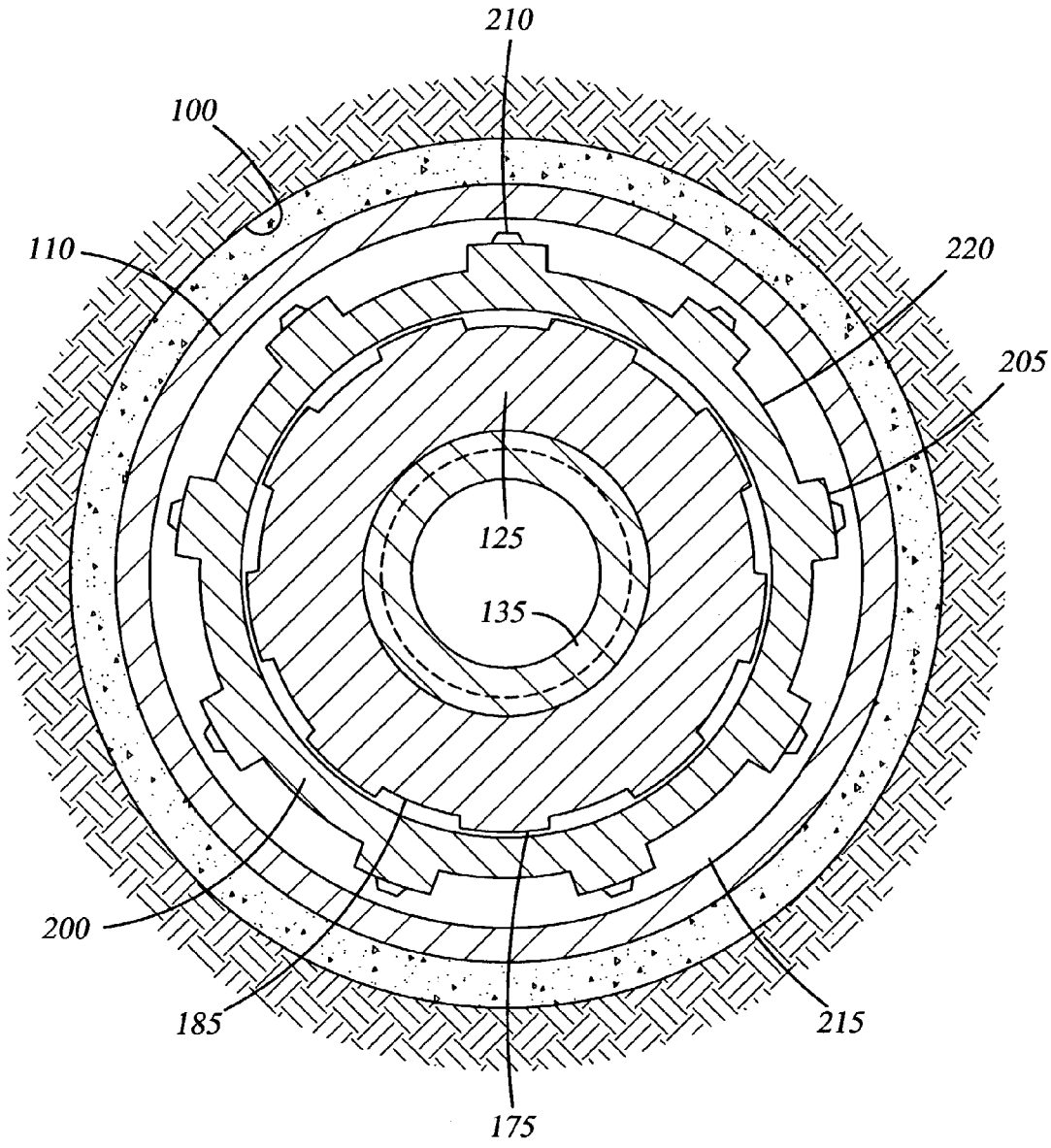
FIG. 3 is a cross-sectional view taken along line 3—3 of FIG. 1 illustrating the expander tool in the solid expandable hanger prior to expansion.

FIG. 3 is a cross-sectional view taken along line 3—3 in FIG. 2 to illustrate the orientation of the expander tool 125 in the solid expandable hanger 200. As clearly shown, the expander tool 125 includes a plurality of formations illustrated as a plurality of expander ribs 175 and a plurality of expander flutes 185 circumferentially spaced around the expander tool 125. The plurality of expander ribs 175 are generally tapered members defining a first outer diameter at a first end smaller than a second outer diameter at a second end thereof. Also clearly shown, the hanger 200 includes a plurality of hanger flutes 220 disposed between the plurality of ribs 205.

Figure 4:
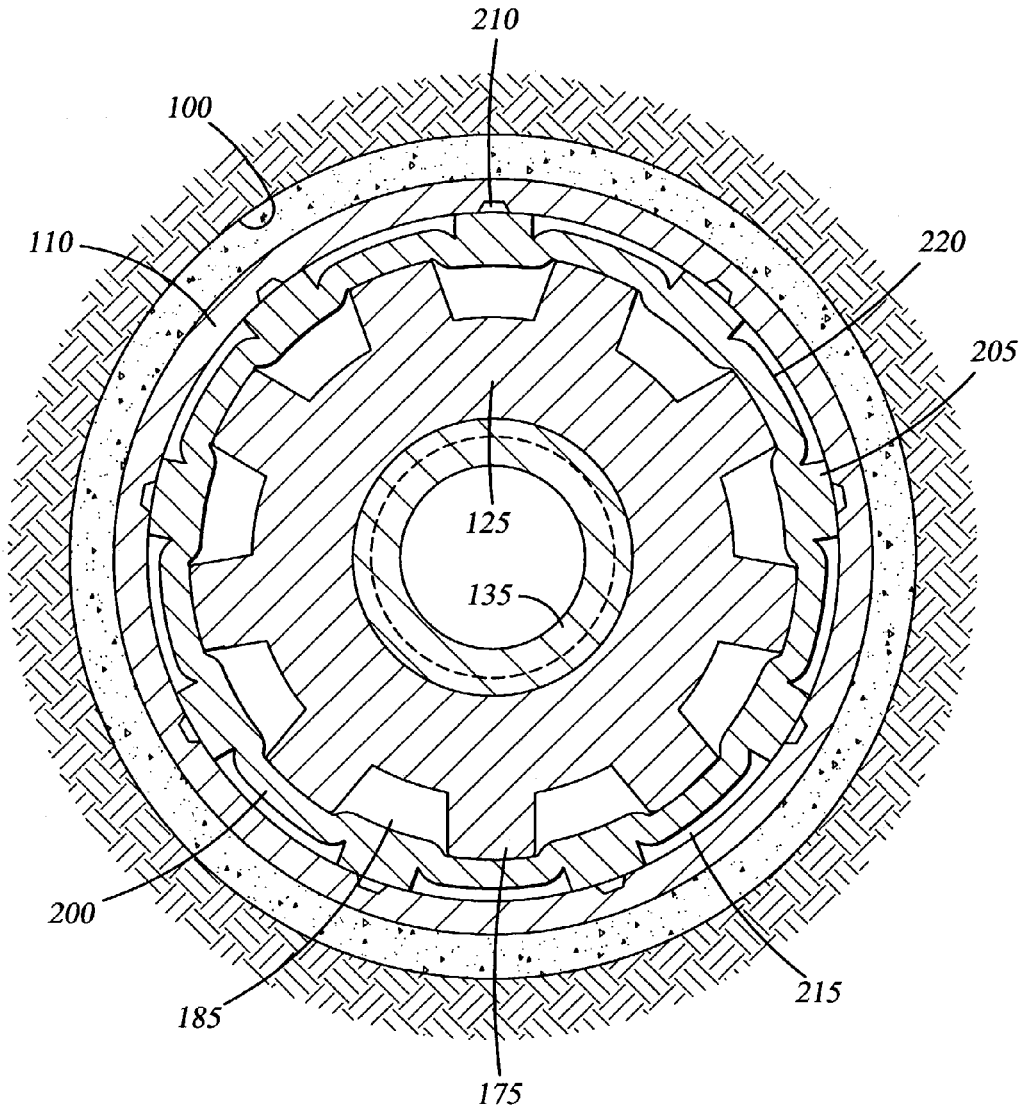
FIG. 4 is a cross-sectional view taken along line 4—4 of FIG. 2 illustrating the expander tool during the expansion of the solid expandable hanger.

FIG. 4 is a cross-sectional view taken along line 4—4 of FIG. 2 illustrating the expander tool 125 during the expansion of the solid expandable hanger 200. The expander tool 125 is oriented in the expandable hanger 200 by aligning the plurality cone flutes 185 with the plurality of ribs 205. Therefore, as the expander tool 125 moves axially through the hanger 200, the cone ribs 175 apply a force on the hanger flutes 220, causing them to expand out radially, which in turn urges the ribs 205 on the hanger 200 out radially as the inserts 210 penetrate the surrounding casing 110. At this point the hanger flutes 220 are free to move out radially while the radially stationary ribs 205 are accommodated by the cone flutes 185. Given that the radial extension of the hanger flutes 220 are dictated by the diameter of the cone ribs 175, they never contact the surrounding casing 110. In this manner, the cement bypass ports 215 are formed thereby providing a fluid passageway between the hanger 200 and the surrounding casing 110 during the cementing operation.

Figure 5:
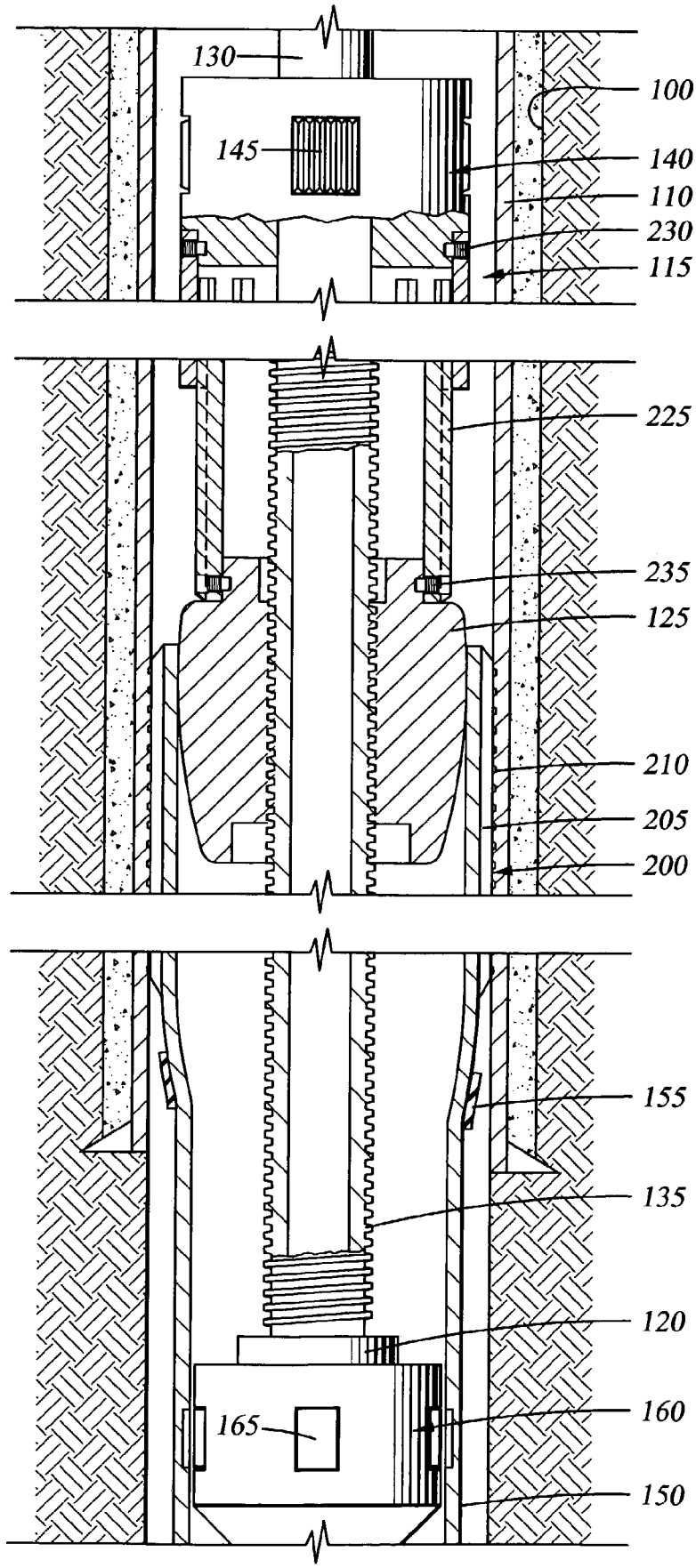
FIG. 5 is a cross-sectional view illustrating the release of the running tool prior to a cementing operation.

FIG. 5 is a cross-sectional view illustrating the release of the running tool 115 prior to a cementing operation. It is desirable to release the running tool 115 from the liner assembly 150 prior to cementing it in the wellbore 100 to prevent the foreseeable difficulty of releasing the tool 115 after the cementation operation. As shown, the torque anchor 140 is also in its recessed position, meaning that the pads 145 have been retracted and are no longer in contact with the casing 110. Furthermore, the hanger 200 supports the weight of the liner assembly 150 therefore the downhole tool 160 is deactivated, meaning that the extendable members 165 have been retracted and are no longer in contact with the inner surface of the liner assembly 150 so as to release the liner assembly 150 from the running tool 115.

Figure 6:
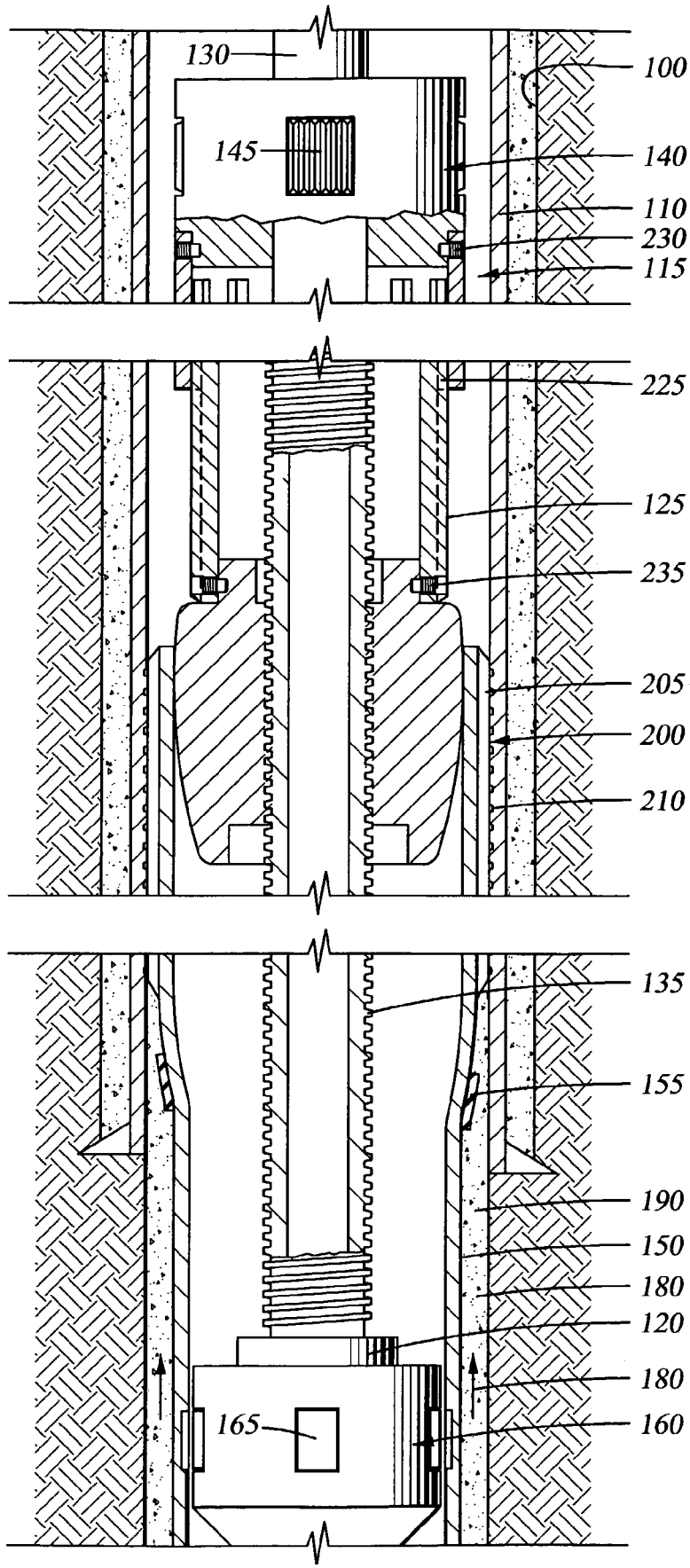
FIG. 6 is a cross-sectional view illustrating the cementation of the liner assembly within the wellbore.

FIG. 6 is a cross-sectional view illustrating the cementation of the liner assembly 150 within the wellbore 100. Preferably, cement is pumped through the working string 130, the running tool 115, and the fluid outlet 170 to a cement shoe (not shown) or another means known in the art to distribute the cement. As indicated by arrow 180, the cement is circulated up an annulus 190 formed between the liner assembly 150 and the wellbore 100 and past the liner seal 155 into the cement bypass ports (not shown) of the expandable hanger 200. Thereafter, the cement flows through the bypass ports and exits into the inner diameter of the surrounding casing 110.

Figure 7:
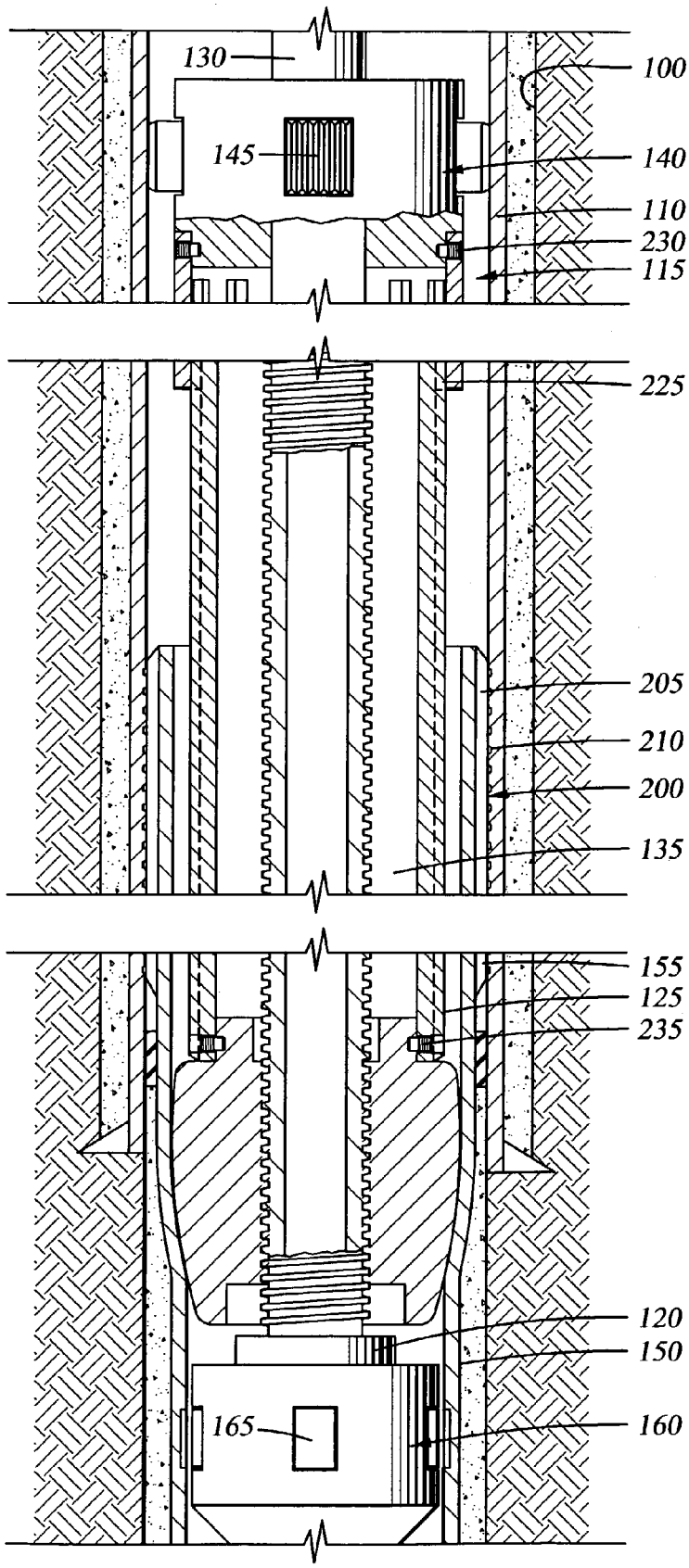
FIG. 7 is a cross-sectional view illustrating the expansion of the liner seal after the cementing operation.

FIG. 7 is a cross-sectional view illustrating the expansion of the liner seal 155 after the cementing operation. As shown, the liner assembly 150 has been completely cemented in the wellbore 100. As further shown, the torque anchor 140 is once again actuated, thereby extending the pads 145 radially outward into contact with the surrounding casing 110. Subsequently, rotational force is transmitted through the working string 130 to the threaded mandrel 135. The swivel 120 permits the threaded mandrel 135 to rotate in the first direction while the supporting torque anchor 140, the spline assembly 225, and the expander tool 125 remain rotationally stationary. As the threaded mandrel 135 rotates in the first direction, the expander tool 125 moves axially in the first direction through the expanded portion of the hanger 200 and then through the liner seal 155. Subsequently, the liner seal 155 expands radially outward forcing the elastomeric material to form a fluid seal between the liner assembly 150 and the surrounding casing 110. Alternatively, a rotary expansion tool (not shown) or a cone shaped mandrel (not shown) may be employed to expand the liner seal 155. In either case, the cement bypass ports (not shown) are sealed off to prevent any further migration of fluid through the expandable hanger 200 from micro-annuluses that may have formed during the cementing operation.

Figure 8:
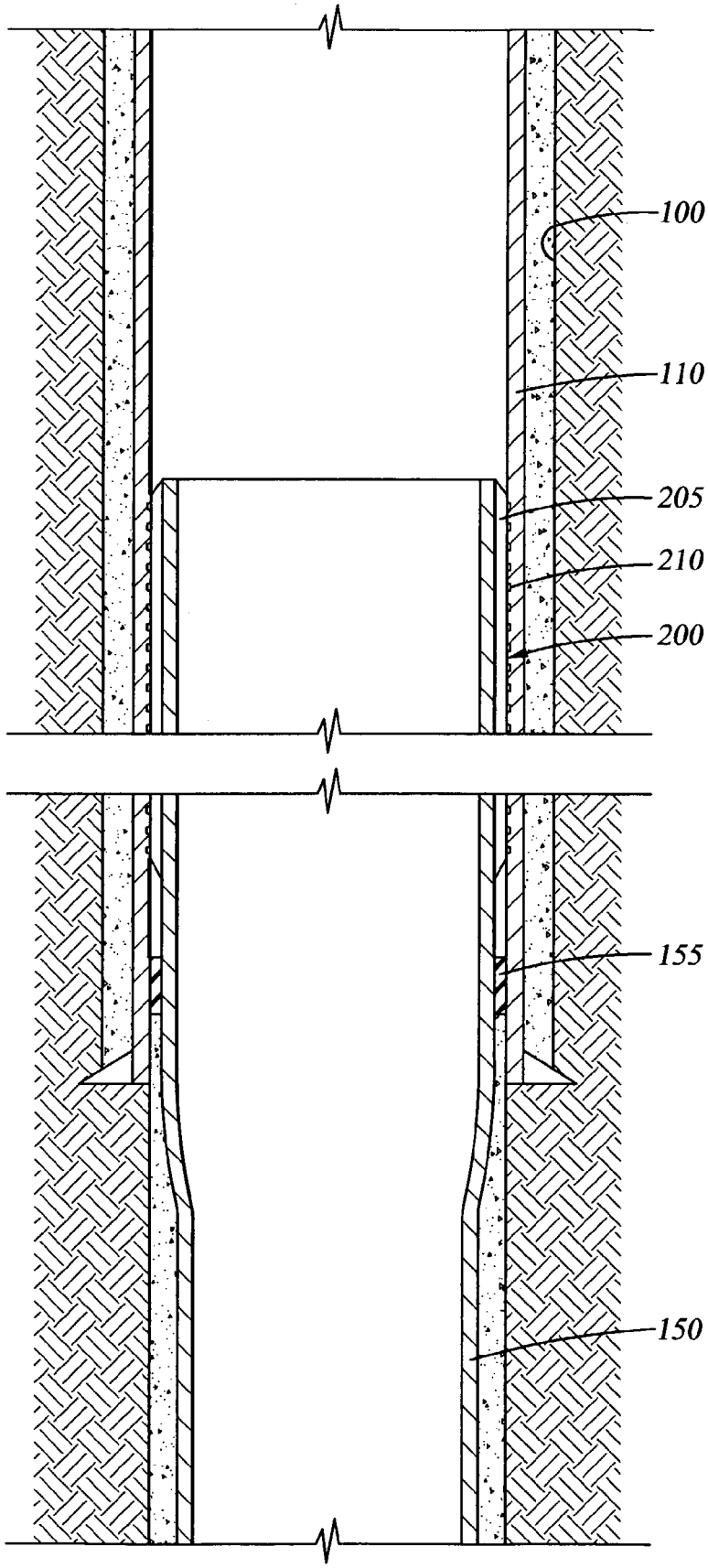
FIG. 8 is a cross-sectional view illustrating the fully expanded solid expandable hanger after the running tool has been removed.

FIG. 8 is a cross-sectional view illustrating the fully expanded solid expandable hanger 200 after the running tool 115 has been removed. As shown, the expandable hanger 200 is fully engaged with the lower portion of the surrounding casing 110 and consequently supporting the entire weight of the liner assembly 150 by way of the inserts 210 on the hanger ribs 205. As further shown, the liner seal 155 has been expanded radially outward and is therefore creating the lower fluid seal between the liner assembly 150 and the surrounding casing 110.

Creating an attachment and a seal between two tubulars in a wellbore can be accomplished with methods that use embodiments of the expandable hanger as described above. A method of completing a wellbore includes placing a first tubular coaxially within a portion of a second tubular, the first tubular including a plurality of formations on an outer surface thereof to provide a frictional relationship between the first tubular and the second tubular while leaving a fluid path through the expanded connection. The method also includes positioning an expander tool within the first tubular at a depth proximate the plurality of formations on the first tubular. The method further includes urging the expander tool axially through the first tubular to expand the first tubular into frictional contact with the second tubular and forming a fluid path through an overlapped portion between the first and second tubulars. Therefore, the apparatus and methods disclosed herein for using embodiments of the expandable hanger permits the connection of two tubulars within a wellbore.

While the foregoing is directed to embodiments of the present invention, other and further embodiments of the invention may be devised without departing from the basic scope thereof, and the scope thereof is determined by the claims that follow.

What is claimed is:

1. An apparatus for forming an expanded connection in a wellbore, the apparatus comprising:

a first tubular being radially expandable outward into contact with an inner wall of a second tubular upon the application of an outwardly directed force supplied to an inner surface of the first tubular by a plurality of rigid protrusions formed on an outer surface of an expander tool; and a plurality of formations formed on an outer surface of the first tubular, the formations constructed and arranged to provide a frictional relationship between the first tubular and the second tubular while leaving a fluid path when the first tubular is expanded to engage the inner wall of the second tubular and when the plurality of protrusions are misaligned with the plurality of formations.

2. The apparatus of claim 1, wherein the plurality of formations is selected from the group comprising of ribs, flutes, and combinations thereof.

3. The apparatus of claim 1, further including gripping means formed on the plurality of formations for further increasing friction between the first and second tubulars upon expansion of the first tubular.

4. The apparatus of claim 3, wherein the gripping means define raised members extending outward from an outer surface of the plurality of formations.

5. The apparatus of claim 4, wherein the raised members define inserts that are press-fitted, epoxied, soldered, threaded or combinations thereof into preformed apertures in the outer surface of the plurality of formations.

6. The apparatus of claim 5, wherein the inserts are fabricated from a hardened metal alloy.

7. The apparatus of claim 5, wherein the inserts are fabricated from a ceramic material.

8. The apparatus of claim 5, wherein the inserts define a plurality of buttons having teeth.

9. The apparatus of claim 1, further including at least one tubular seal disposed on the outer surface of the first tubular, wherein the at least one tubular seal is radially expandable to create a fluid seal between the first and second tubulars.

10. The apparatus of claim 9, wherein the at least one tubular seal is fabricated from an elastomeric material.

11. The apparatus of claim 1, wherein the protrusions define a first outer diameter at a first end smaller than a second outer diameter at a second end thereof.

12. A method of completing a wellbore, comprising;

positioning a first tubular coaxially within a portion of a second tubular, the first tubular including a plurality of formations on an outer surface thereof to provide a frictional relationship between the first tubular and the second tubular while leaving a fluid path through the expanded connection;

positioning an expander tool within the first tubular such that a plurality of tool formations on the expander tool are misaligned with the plurality of formations on the first tubular;

urging the expander tool axially through the first tubular to expand the first tubular into frictional contact with the second tubular; and forming a fluid path through an overlapped portion between the first and second tubulars.

13. The method of claim 12, wherein the plurality of tool formations are formed circumferentially around an outer surface of the expander tool.

14. The method of claim 13, wherein the plurality tool formations are aligned with a plurality of flutes on the first tubular.

15. The method of claim 12, further including circulating cement through the wellbore and subsequently through the fluid path to secure the first tubular in the wellbore.

16. The method of claim 15, wherein at least one tubular seal is disposed around the first tubular.

17. The method of claim 16, further including expanding the at least one tubular seal to close off the fluid path and create a fluid seal between the first and second tubulars.

18. An apparatus for forming an expanded connection in a wellbore, comprising:

a first tubular having a radially expandable end portion received in an end of a second tubular having an inner diameter large enough to receive the expandable end portion of the first tubular;

gripping means between the first tubular end portion and the inner diameter of the second tubular;

an axially movable expander positioned for entry into the first tubular expandable end portion to expand the end portion into gripping engagement with the inner diameter of the second tubular, the axially movable expander having a plurality of rigid outwardly extending substantially longitudinal formations configured to expand the radially expandable end portion; and a plurality of longitudinally extending passageways between the engaged tubular portions, wherein the longitudinal formations of the expander are aligned with the plurality of longitudinally extending passageways.

19. An apparatus for engaging a first tubular and a second tubular in a wellbore, the apparatus comprising:

a tubular body formed on the first tubular, having an inner surface and an outer surface, the tubular body being expandable radially outward into contact with an inner wall of the second tubular by the application of an outwardly directed force supplied to the inner surface of the tubular body by an expander tool, wherein the expander tool includes a plurality of longitudinally formed tool flutes and tool ribs formed on an outer surface thereof; and a plurality of ribs with a plurality of flutes spaced therebetween formed around the outer circumference of the tubular body, the plurality of ribs constructed and arranged to provide a frictional relationship between the tubular body and the inner surface of the second tubular while leaving a fluid path through the expanded connection, wherein the expander tool is oriented in the tubular body to align the plurality tool ribs with the plurality of flutes on the tubular body.

20. The apparatus of claim 19, further including a gripping means formed on the plurality of ribs for further increasing friction between the tubular body and the second tubular upon expansion of the tubular body.

21. The apparatus of claim 19, further including at least one tubular seal disposed on the outer surface of the tubular body, wherein the at least one tubular seal is radially expandable to create a fluid seal between the tubular body and second tubular.

22. An apparatus for forming an expanded connection, comprising:

a body; and a plurality of rigid substantially longitudinal formations formed on the body, the plurality of formations configured to form the expanded connection, wherein the plurality of formations are constructed and arranged to be orientated in an alternating relationship between a plurality of ribs formed on a tubular to expand the tubular into contact with a larger tubular while leaving a fluid path therebetween.

23. The apparatus of claim 22, wherein the plurality of formations defining a first outer diameter at a first end smaller than a second outer diameter at a second end thereof.

* * * * *